US011853088B2

(12) United States Patent
Jenkins et al.

(10) Patent No.: US 11,853,088 B2
(45) Date of Patent: Dec. 26, 2023

(54) LINKING SEPARATE EFUSE AND ORING CONTROLLERS FOR OUTPUT OVERVOLTAGE PROTECTION IN REDUNDANT POWER CONVERTERS

(71) Applicant: International Business Machines Corporation, Armonk, NY (US)

(72) Inventors: Luke L. Jenkins, Poughkeepsie, NY (US); Mark L. Demarie, Poughkeepsie, NY (US); Steven G. Shevach, Hurley, NY (US); Peter A. Wendling, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 114 days.

(21) Appl. No.: 17/468,922

(22) Filed: Sep. 8, 2021

(65) Prior Publication Data

US 2023/0076383 A1 Mar. 9, 2023

(51) Int. Cl.
*G05F 1/56* (2006.01)

(52) U.S. Cl.
CPC ..... *G05F 1/56* (2013.01)

(58) Field of Classification Search
CPC ..... G05F 1/56
USPC ..... 323/265
See application file for complete search history.

(56) References Cited

U.S. PATENT DOCUMENTS

| | | | | |
|---|---|---|---|---|
| 6,031,743 | A * | 2/2000 | Carpenter | H02J 1/001 363/124 |
| 7,787,222 | B2 * | 8/2010 | Covi | H02M 1/32 361/18 |
| 8,861,164 | B2 | 10/2014 | Mikolajczak | |
| 9,836,104 | B2 * | 12/2017 | Purcell | G06F 1/26 |
| 10,283,475 | B2 * | 5/2019 | Ward | H01L 25/0655 |
| 10,615,691 | B1 * | 4/2020 | Miller | G05F 1/62 |
| 10,714,923 | B2 | 7/2020 | O'Sullivan et al. | |
| 2004/0227495 | A1 * | 11/2004 | Egan | G05F 1/618 323/272 |
| 2007/0035899 | A1 * | 2/2007 | Covi | H02M 3/1584 361/56 |
| 2007/0279813 | A1 * | 12/2007 | Covi | H02M 1/32 361/18 |
| 2010/0087036 | A1 * | 4/2010 | Lotfi | H01L 23/49589 438/122 |
| 2018/0109197 | A1 * | 4/2018 | Quigley | H02M 1/36 |
| 2020/0389009 | A1 | 7/2020 | O'Sullivan et al. | |
| 2020/0287374 | A1 | 9/2020 | La Rosa et al. | |
| 2021/0119538 | A1 * | 4/2021 | Leong | H02M 3/156 |

* cited by examiner

*Primary Examiner* — Yemane Mehari
(74) *Attorney, Agent, or Firm* — CANTOR COLBURN LLP; Tihon Poltavets

(57) ABSTRACT

Embodiments for linking separate eFuse and ORING controllers for output overvoltage protection in power conversion applications. Voltage regulators are configured in parallel. An input circuit includes an input controller, the input circuit being coupled to an input of at least one voltage regulator of the voltage regulators. An output circuit includes an output controller, the output circuit being coupled to an output of the at least one voltage regulator. The output controller is coupled to the input circuit to cause the input circuit to prevent power to the at least one voltage regulator in response to the output controller detecting an overvoltage condition.

17 Claims, 10 Drawing Sheets

LINKING SEPARATE EFUSE AND ORING CONTROLLERS FOR OUTPUT OVERVOLTAGE PROTECTION IN REDUNDANT POWER CONVERTERS

BACKGROUND

The present invention generally relates to computer systems, and more specifically, to computer-implemented methods, computer systems, and computer program products configured and arranged for linking separate electronic fuse (eFuse) and ORING controllers for output overvoltage protection in in redundant power converters.

Computer systems typically utilize parallel power supply systems. A parallel power supply system generally includes a plurality of power sources such as DC-DC (direct current) converters or voltage regulators connected in parallel to provide current to a load having one or more processors, memory devices, disk drives, etc. Existing parallel power supplies employ various techniques to address overvoltage (also called overvoltage), current spikes, etc. ORING or ORing controller integrated circuits are used to realize such redundant power supply configurations. In this scheme, two or more voltage outputs are ORed together, which means they are connected in a logical "OR" configuration, to a common output. In the event that one input supply fails or shorts, the ORING circuit protects the redundant output bus, neighboring phases, and the system load by preventing current from flowing from the common output back into the regulator phase. The electronic fuse (eFuse, e-fuse, etc.) is an electrical safety device that operates to provide input current protection of an electrical circuit. The eFuse can be set up to trip at a very specific current, and if the current is exceeded, the eFuse will disconnect the load.

SUMMARY

Embodiments of the present invention are directed to a circuit for linking separate electronic fuse (eFuse) and ORING controllers for output overvoltage protection in redundant power converters. A non-limiting example circuit includes voltage regulators configured in parallel. The circuit includes an input circuit having an input controller, the input circuit being coupled to an input of at least one voltage regulator of the voltage regulators. Also, the circuit includes an output circuit having an output controller, the output circuit being coupled to an output of the at least one voltage regulator. The output controller is coupled to the input circuit to cause the input circuit to prevent power to the at least one voltage regulator in response to the output controller detecting an overvoltage condition.

According to one or more embodiments, a method is provided. The method includes providing voltage regulators configured in parallel and coupling an input circuit having an input controller to an input of at least one voltage regulator of the voltage regulator. The method includes coupling an output circuit having an output controller to an output of the at least one voltage regulator, the output controller being coupled to the input circuit to cause the input circuit to prevent power to the at least one voltage regulator in response to the output controller detecting an overvoltage condition.

According to one or more embodiments, a method is provided. The method includes detecting, using an output circuit, an overvoltage condition, the output circuit comprising an output controller and being coupled to an output of at least one voltage regulator of voltage regulators configured in parallel. An input circuit includes an input controller and is coupled to an input of the at least one voltage regulator. The method includes communicating via a pin of the output controller with the input controller to cause the input controller to prevent power to the at least one voltage regulator.

Other embodiments of the present invention implement features of the above-described method in computer systems and computer program products.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

DETAILED DESCRIPTION

Figure 1:
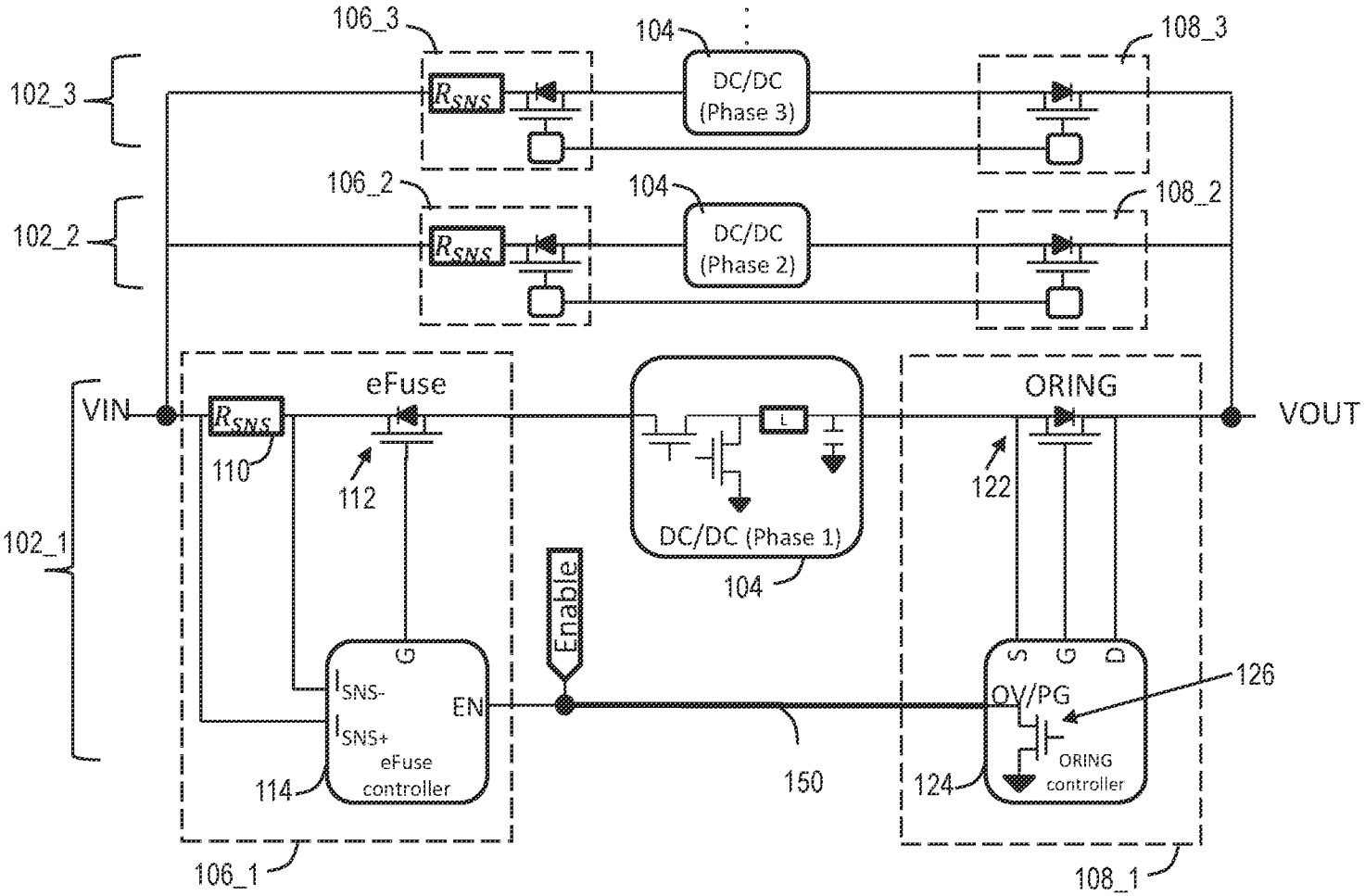
FIG. 1 depicts a schematic of an example circuit configured to protect against overvoltage failures according to one or more embodiments of the present invention.

One or more embodiments of the present invention provide computer-implemented methods, computer systems, and computer program products arranged and configured for linking separate electronic fuse (eFuse) and ORING controllers for output overvoltage protection in power conversion applications. One or more embodiments of the invention are arranged to connect an output ORING controller, which has visibility to output overvoltage events, to eFuse circuit. When an output overvoltage occurs, the eFuse in the eFuse circuit is immediately turned off based on being coupled to the ORING controller. This can be accomplished in various ways, depending on the ORING controller's pinout and the eFuse controller's pinout. One or more embodiments may connect the ORING controller's open-drain Power Good (PG) pin to the eFuse Enable (EN) pin of an eFuse controller, as depicted further herein. When the ORING controller detects an output overvoltage, the ORING controller pulls the PG pin low through its internal open-drain metal-oxide-semiconductor field-effect transistor (MOSFET). This in turn pulls the eFuse EN pin low, which turns off the eFuse. With the eFuse turned off, the output voltage begins to drop and does not exceed the overvoltage threshold selected by the ORING controller. As discussed herein, one or more embodiments can provide superior output overvoltage protection with separate eFuse and ORING controllers and with minimal added cost, complexity, and size.

To perform redundant power conversion, each phase is to have input protection (eFuse) and output protection (ORING). This protects the input and output busses and neighboring phases from voltage droop if a faulty phase were to sink high current. However, this still leaves vulnerable single points of failure (SPoF) in the state-of-the-art. In redundant multiphase power conversion, input protection (eFuse) and output protection (ORING) are to isolate a faulted phase from the other non-faulted phase(s). Protection might be accomplished when a single integrated circuit (IC) has visibility to both the input eFuse and output ORING, because the since IC can make the best protection decisions since the single IC has visibility to both. However, in some applications, separate eFuse and ORING devices (including separate controllers) are necessary, due to size constraints, architectural requirements, bills of material (BOM) cost, and/or other reasons. For example, while every phase needs output ORING protection, a single eFuse controller can be shared between multiple phases to save size and cost. In this example, separate eFuse and ORING controllers are necessary (which means that the eFuse and ORING controllers are on separate ICs or separate chips), but some fault scenarios are not well-protected, such as an output overvoltage. In an output overvoltage, the ORING controller has visibility to the output (e.g., the voltage output VOUT), so the ORING controller knows that the phase has faulted, but the input eFuse controller inherently does not. This is a problem because it is beneficial to immediately turn off the eFuse to prevent further output overvoltage and avoid damage.

A primary single point of failure is an output overvoltage (OV), which can be caused in a number of ways. For reference, some common causes of output overvoltage in a synchronous buck converter include high-side (HS) MOSFET short, open or damaged remote sense lines, pulse width modulation (PWM) faults, such as PWM stuck high, and inductor failure or saturation. Of these mechanisms, the most common results in a HS MOSFET that either fails shorted or remains turned on too long. This means that, if left unprotected, the entire input voltage less (minus) the ORING body diode drop (~0.7 volts (V)) could appear at the output voltage (e.g., VOUT). If this were a 12V-to-1V application, significant damage would occur, for example, if a 11.3 V appeared on a net designed for 1V. Not turning the eFuse off quickly may result in further damage, a smoke event, or a critical fault despite redundancy. Although various examples discussed herein may use the buck converter topology, it should be appreciated that various power conversion topologies are applicable. As discussed further herein, one or more embodiments provide an intelligent and reliable way of turning off the eFuse quickly during an output overvoltage.

According to one or more embodiments of the present invention, it is desirable to use the smallest (e.g., in terms of size, real estate used on a circuit board, and/or number of components) eFuse and ORING solution available for extremely dense redundant power conversion. To address the case where the ORING controller has visibility to an output overvoltage and the circuit needs the eFuse to turn off during the output overvoltage, which does not have output visibility, one or more embodiments are configured to create a link between a separate eFuse controller and an ORING controller to turn off the eFuse when the ORING controller detects an output overvoltage. This solution also allows multiple phases to share an eFuse (i.e., a single eFuse) while maintaining individual ORINGs for superior flexibility. The link between ORING and eFuse controllers can be made in several different ways, according to one or more embodiments. Different implementations may have trade-offs between performance and complexity. In one or more embodiments, any pin on the eFuse controller that can turn off the eFuse may be used; similarly, any pin on the ORING controller that is pulled high or low during an output overvoltage can be used. For illustration purposes and ease of understanding, various examples use the open-drain Power Good (PG) pin of the ORING controller and the enable (EN) pin of the eFuse controller, because this uses market-available parts without requiring unique silicon development; however, it should be appreciated that one or more embodiments are not meant to be limited to the same.

FIG. 1 depicts a schematic of an example circuit 100 that protects against overvoltage failures according to one or more embodiments of the invention. Circuit 100 has redundant power conversion with N phases, where N is the total number of phases in the redundant power supply level. In this example three phases are shown which are phase 1, phase 2, and phase 3, but more or fewer phases can be utilized. Accordingly, circuit 100 illustrates three redundant power rails/busses, which are depicted as power rails 102_1, 102_2, 102_3, where each phase of the power rails has input protection (eFuse) and output protection (ORING). Power rails 102_1, 102_2, 102_3 can generally be referred to as power rails 102, and more or fewer power rails can be utilized. The redundant power conversion with power rails 102 protect the input and output busses and neighboring phases from voltage droop if a faulty phase were to sink high current. Each power rail 102_1, 102_2, 102_3 has a separate (phase) voltage regulators 104. The voltage regulator 104 can be representative of any standard voltage regulator, as understood by one of ordinary skill in the art. In circuit 100, electrical current flows from input voltage terminal VIN, through respective voltage regulators 104, and eventually to output voltage terminal VOUT. Accordingly, each voltage regulator 104 has an input side or bus and an output side or bus. For power rails 102_1, 102_2, 102_3, the input side/bus includes input circuits 106_1, 106_2, 106_3, respectively, while the output side/bus includes output circuit 108_1, 108_2, 108_3, respectively. Input circuits 106_1, 106_2, 106_3 can generally be referred to input circuits 106 and can be electronic fuse (eFuse) circuits. The output circuits 108_1, 108_2, 108_3 can generally be referred to as output circuits 108 and can be ORING circuits.

For the sake of conciseness, the details of input circuit 106_1 and output circuit 108_1 of power rail 102_1 are highlighted in FIG. 1 and will be further described. It should be appreciated that the description of input circuit 106_1 and output circuit 108_1 of power rail 102_1 applies by analogy to input circuits 106_2, 106_3 and output circuits 108_2, 108_3 of power rails 102_2, 102_3. Input circuit 106_1 includes a remote current sense device which is illustrated as current sense resistor 110. Input circuit 106_1 includes an eFuse 112 which can be implemented as a MOSFET having its body diode opposing the direction of current flow. Although a transistor (i.e., MOSFET transistor) is depicted, the eFuse 112 may be any resettable electronic device that can be controlled to block or disconnect power (e.g., as an open circuit) to voltage regulator 104. Additionally, input circuit 106_1 includes an input circuit controller 114 which can be an eFuse controller. Input circuit controller 114 is connected to both current sense resistor 110 and eFuse 112. Input circuit controller 114 (e.g., as an eFuse controller) can be an integrated circuit on a chip having standard pins for operation as an eFuse controller as understood by one skilled in the art. For illustration and not limitation, a positive sense current pin (e.g., +ISNS) is connected to the input terminal (i.e., input side) of current sense resistor 110 while a negative sense current pin (e.g., −ISNS) of input circuit controller 114 is connected to the output terminal of current sense resistor 110. The difference in current measured by input circuit controller 114 using the positive and negative sense current pins is used to determine an overcurrent. The gate pin (e.g., G) of input circuit controller 114 is connected the gate of eFuse 112 and is used to control eFuse 112 (e.g., turn on and turn off) according to internal conditions and/or the value at an enable (EN) pin. As an example configuration, a high value such as a predetermined high voltage (e.g., 1) at the enable pin of input circuit controller 114 causes input circuit controller 114 to turn on eFuse 112, while a low value such as a predetermined low voltage (e.g., 0) at the enable pin of input circuit controller 114 causes input circuit controller 114 to turn off eFuse 112.

Output circuit 108_1 includes an ORING device 122 which can be implemented as a MOSFET having its body diode in the same direction as current flow. Although a transistor (i.e., MOSFET transistor) is depicted, ORING device 122 may be any resettable electronic device that can be controlled to block or disconnect power (e.g., as an open circuit) between voltage regulator 104 and the output VOUT. Additionally, output circuit 108_1 includes an output circuit controller 124 which can be an ORING controller. Output circuit controller 124 is connected to the source terminal, gate terminal, and drain terminal of ORING device 122 via a source pin, gate pin, and drain pin, respectively. Output circuit controller 124 has an overvoltage (OV) or Power Good (PG) pin, which is internally connected to the drain of an n-type transistor (NFET) (e.g., MOSFET) which depicted as internal transistor 126. Internal transistor 126 is internal to output controller 124. Internal transistor 126 has an open drain at the Power Good (PG) pin and its source connected to ground. Upon detection of an overvoltage, output circuit controller 124 is configured to turn on internal transistor 126 which pulls the open drain to ground. Output circuit controller 124 uses the source pin (S) to detect an overvoltage. The overvoltage or overvoltage condition occurs when the voltage at output VOUT is greater than a predetermined threshold voltage. Output circuit controller 124 (e.g., as an ORING controller) can be an integrated circuit on a chip having standard pins for operation as an ORING controller as understood by one skilled in the art.

Circuit 100 includes a direct connection 150 from output circuit controller 124 (e.g., ORING controller) to input circuit controller 114 (e.g., eFuse controller). Direct connection 150 can be a wire, wire trace, and/or any electrical connection on a circuit board. There are various techniques for using direction connection 150 as discussed further herein, according to one or more embodiments. If an output overvoltage occurs, output circuit controller 124 (e.g. ORING controller) detects the overvoltage, and the internal transistor 126 (e.g., PG open-drain MOSFET) pulls the PG pin to ground. In turn, this pulls the enable pin (e.g., eFuse EN pin) of input circuit controller 114 to ground, and the eFuse 112 turns off. Because the input VIN is disconnected, the output voltage VOUT will lower at a rate determined by COUT and IOUT, where IOUT is the current through ORING device 122 and COUT is an external capacitance (capacitor is now shown) at the load.

Once the output voltage VOUT is reduced below the predetermined overvoltage threshold (e.g., ORING overvoltage threshold) which is a predetermined value, the eFuse 112 is turned back on because internal transistor 126 is turned off and is no longer pulling the value at the enable pin to ground. As can be seen, FIG. 1 depicts the ORING controller PG pin connected to eFuse controller EN pin to disable the eFuse under an output overvoltage event. This approach works very well at turning off the eFuse 112 during an overvoltage event. This is far superior to omitting overvoltage protection or relying on an input eFuse overcurrent trip to protect the load on the output. If the fault, such as a shorted HS MOSFET, still exists, the overvoltage process repeats. This repeating loop will prevent damage to any load, such as memory devices, connected to output voltage VOUT. FIG. 1 also illustrates an enable tab connected to the enable pin of output circuit controller 124, and the enable tab represents an input signal from a controlling device such as microcontroller that is used to control output circuit controller 124 under normal operating conditions. However, upon detection of the overvoltage event, internal transistor 126 is large enough to sink (i.e., pull low) the control signal (represented by the enable tab) from the microcontroller, thereby pulling the enable pin to ground and turning off eFust 112.

Figure 2:
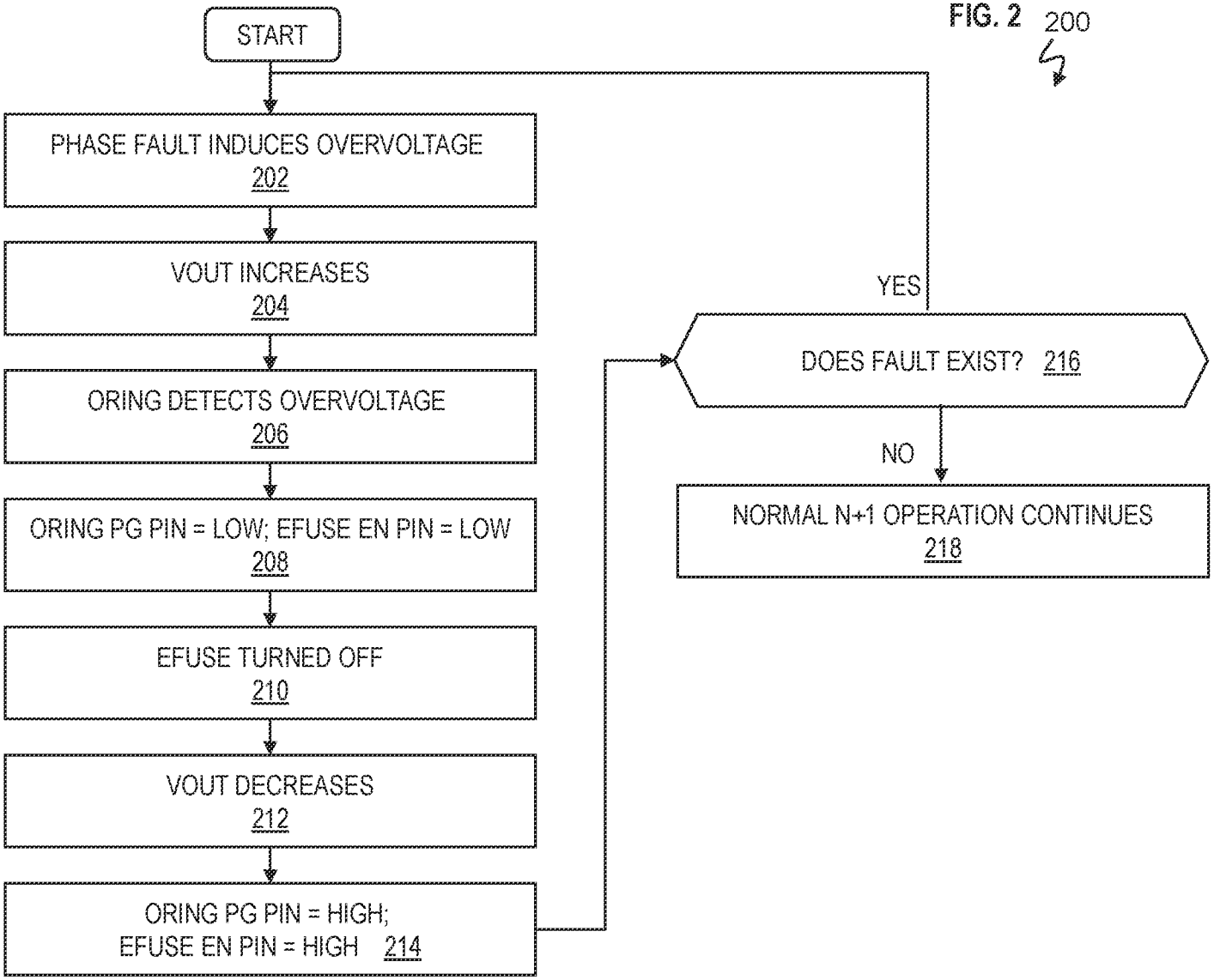
FIG. 2 depicts a flowchart of a process to protect a circuit in the event of an overvoltage condition in accordance with one or more embodiments of the present invention.

FIG. 2 depicts a flowchart of a process 200 to protect circuit 100 in the event of an overvoltage condition according to one or more embodiments. At block 202, a phase fault induces an overvoltage on one or more power rails 102. At block 204, output voltage VOUT increases in response to the overvoltage. At block 206, output circuit controller 124 is configured to detect the overvoltage, for example, using the source (e.g., S) pin. At block 208, output circuit controller 124 is configured to pull the PG pin low by turning on internal transistor 126, which in turns pulls the eFuse enable (e.g., EN) pin low on input circuit controller 114. As such, eFuse 112 is turned off at block 210, and output voltage VOUT decreases at block 212. As a result of the decreases in output voltage VOUT, output circuit controller 124 is configured to pull up the PG pin to high by turning of internal transistor 126 at block 214, which in turn pulls up the eFuse enable (e.g., EN) pin on input circuit controller 114. At block 216, output circuit controller 124 is configured to check if the fault persists. If Yes, flow returns to block 202, and if NO, normal N+1 operation continues for the power rails 102 at block 218. This loop continues repeating or retrying, thereby protecting the load (not shown) from the overvoltage condition.

Figure 3:
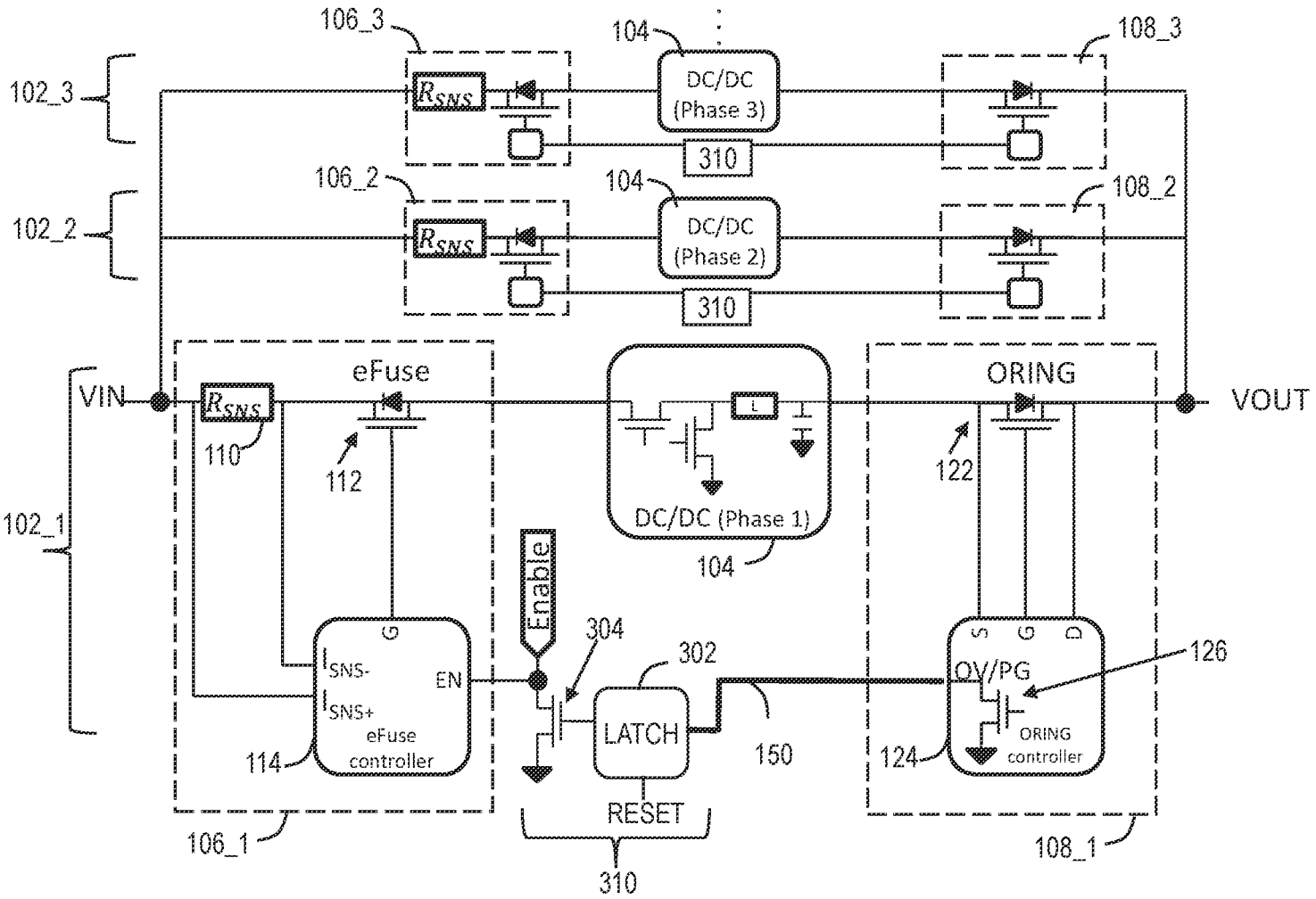
FIG. 3 depicts a schematic of an example circuit configured to protect against overvoltage failures according to one or more embodiments of the present invention.

FIG. 3 depicts a schematic of an example circuit 100 that protects against overvoltage failures according to one or more embodiments of the invention. In FIG. 3, a latch 302 is placed between input circuit controller 114 (e.g., eFuse controller) and output circuit controller 124 (e.g., ORING controller), which can prevent the retry loop discussed above. In one or more embodiments, an ORING device could be designed to "latch off", which would eliminate use of an external latch because the ORING device includes the functionality of a latch. In one or more embodiments, the ORING device could include firmware configured to perform the functionality of the latch.

Latch 302 could be coupled to the gate of a pulldown transistor 304 having its source connected to ground and its drain connected to the enable pin of input circuit controller 114. Pulldown transistor 304 could be an NFET. Latch 302 could be a set/reset (SR) latch, where a microcontroller or system firmware is connected to the RESET pin (retry pin) of latch 302, and the PG pin of output circuit controller 124 is connected to the SET pin of latch 302. The output Q of latch 302 is coupled to the enable pin of input circuit controller 114. Latch circuit 310 is the combination of pulldown transistor 304 and latch 302.

Figure 4:
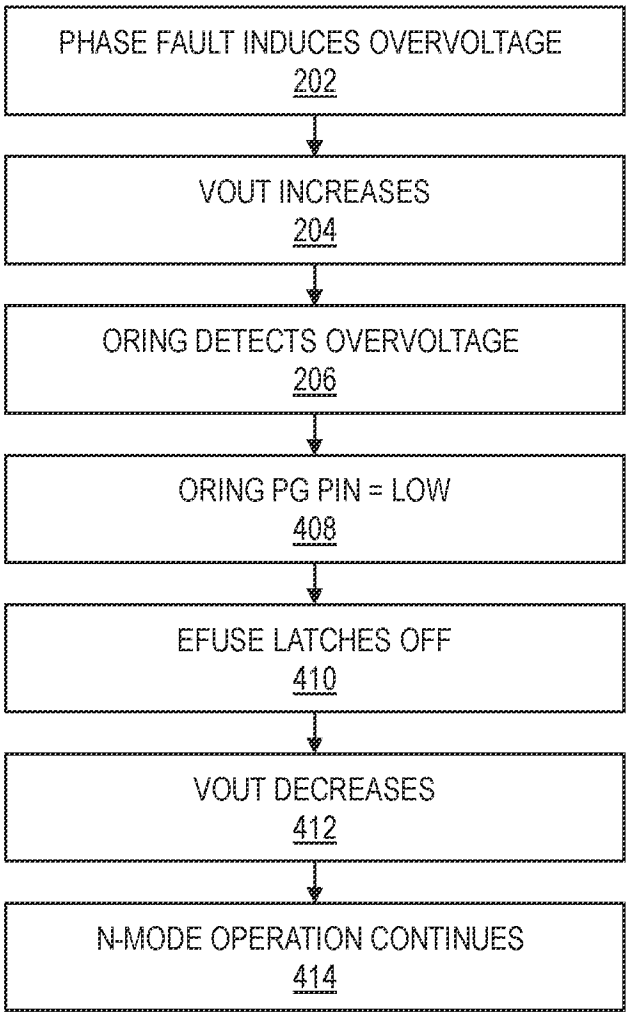
FIG. 4 depicts a flowchart of a process to protect a circuit in the event of an overvoltage condition in accordance with one or more embodiments of the present invention.

FIG. 4 depicts a flowchart 400 of a process to protect circuit 100 modified with latch 302 and pulldown transistor 304 in the event of an overvoltage according to one or more embodiments. Blocks 202, 204, and 206 are repeated from FIG. 2 and may be discussed briefly. A phase fault induces an overvoltage on one or more power rails 102 at block 202, output voltage VOUT increases in response to the overvoltage at block 204, and output circuit controller 124 detects the overvoltage at block 206. At block 408, output circuit controller 124 is configured to pull the PG pin low by turning on internal transistor 126, which in turn sends a low (e.g., 0) to latch 302. Latch 302 outputs and holds a high voltage (e.g., 1) at the gate of pulldown transistor 304, thereby turning on pulldown transistor 304 which then turns off eFuse 112 at block 410. As such, output voltage VOUT decreases at block 412, and N-mode operation continues for circuit 100 at block 414. In other words, other phases continue to operate while the phase experiencing the overvoltage is latched off. Latch 302 remains latched at a high output to constantly pulldown transistor 304, which prevents a retry loop. Overvoltage protection is provided until output voltage VOUT returns into regulation after the overvoltage event. A microcontroller (not shown) can reset latch 302 after the overvoltage, and the microcontroller could be coupled to the PG pin of output circuit controller 124 to know when to reset latch 302.

Figure 5:
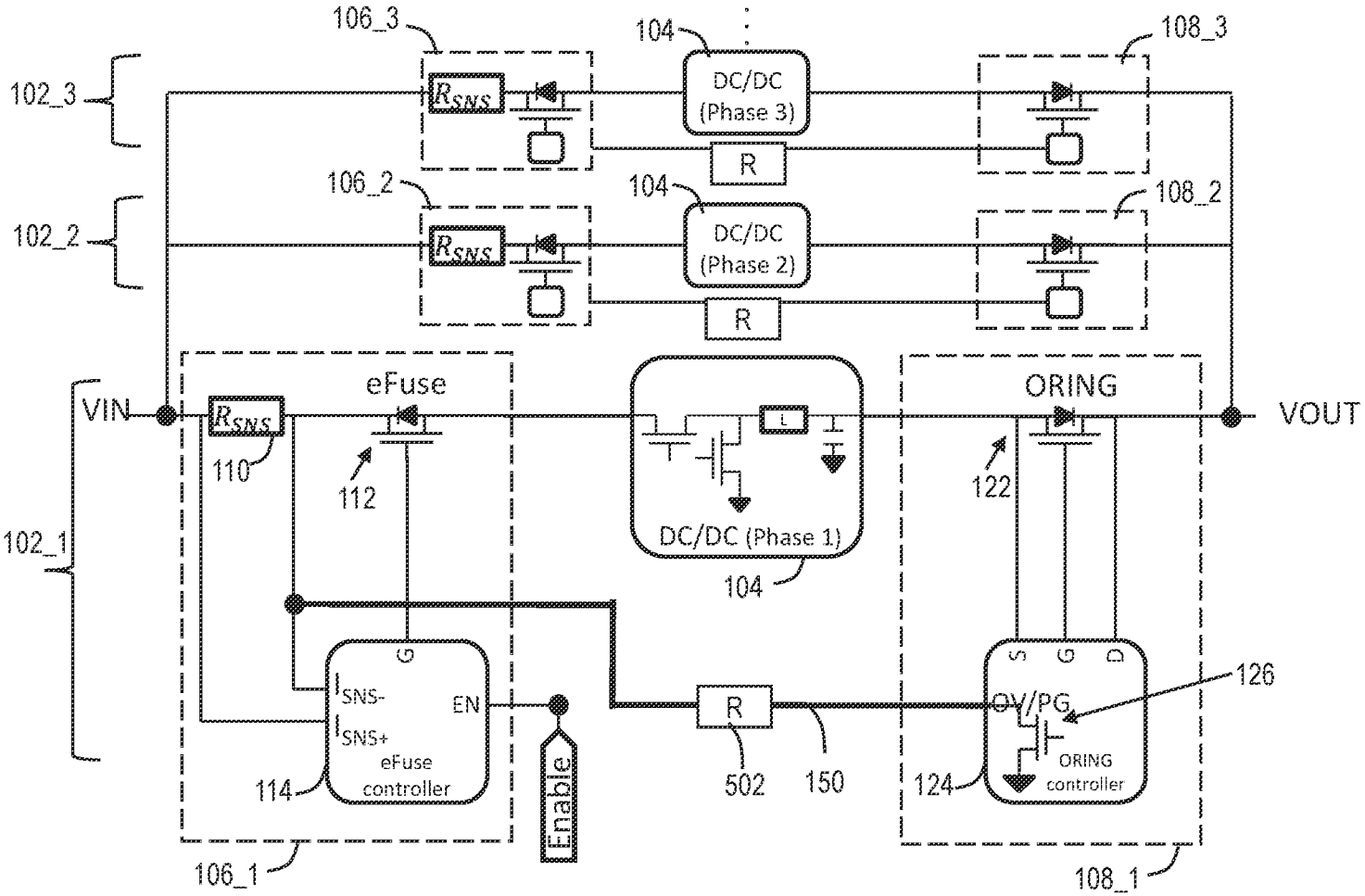
FIG. 5 depicts a schematic of an example circuit configured to protect against overvoltage failures according to one or more embodiments of the present invention.

FIG. 5 depicts a schematic of an example circuit 100 that protects against overvoltage failures according to one or more embodiments of the invention. FIG. 5 illustrates output circuit controller 124 (e.g., ORING controller) connected to the negative current sense pin (e.g., –ISNS pin) of input circuit controller 114 (e.g., eFuse controller) via a resistor 502. The functionality of FIG. 5 is similar to FIG. 3, except input circuit controller 114 (e.g., eFuse controller) is manipulated into operating as though it detects an input overcurrent, because the PG pin of output circuit controller 124 (e.g., via internal transistor 126) pulls the negative current sense pin (e.g., –ISNS pin) to ground via resistor 502 when output circuit controller 124 detects an overvoltage at source pin (e.g., S pin). Additionally, if input circuit controller 114 (e.g., eFuse controller) is designed to latch off, this accomplishes the same function as FIG. 3 but with fewer components. This approach could save space, cost, and design complexity. In one or more embodiments, the PG pin of output circuit controller 124 could be connected to and utilized to pull down the eFuse gate of eFuse 112.

Figure 6:
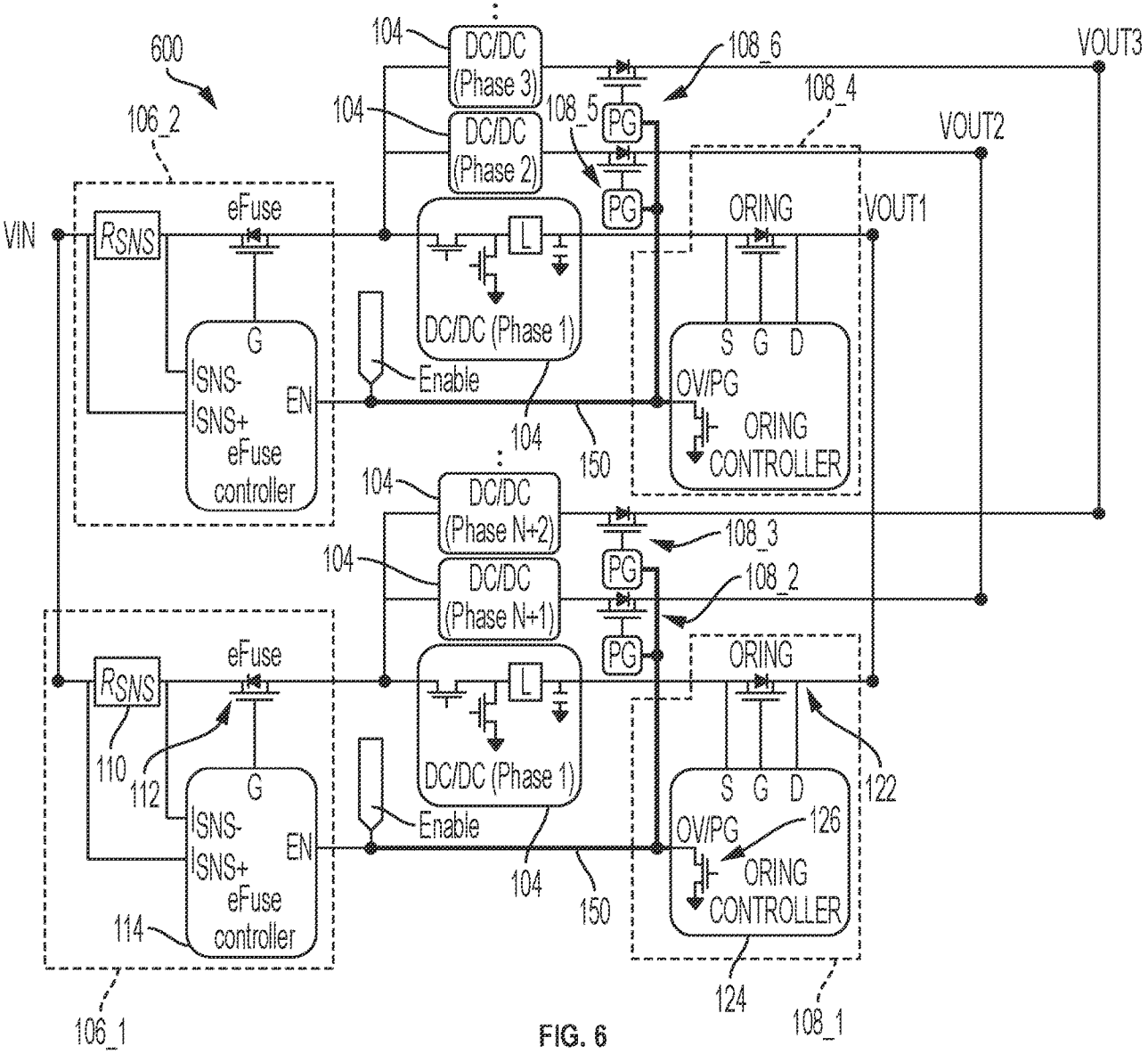
FIG. 6 depicts a schematic of an example circuit configured to protect against overvoltage failures according to one or more embodiments of the present invention.

FIG. 6 depicts a schematic of an example circuit 600 that protects against overvoltage failures according to one or more embodiments of the invention. Circuit 600 is similar to the operation of circuit 100 except a single input control circuit is utilized to protect multiple power rails or phases on the input side/bus. Using separate eFuse circuits and ORING circuits while maintaining output overvoltage protection provides superior flexibility. For example, FIG. 6 illustrates how multiple phases can share an eFuse input circuit while each phase still requires independent ORING circuits. In this case, the open-drain PG MOSFETs from multiple ORING controllers can be connected, such that a fault in any one ORING controller will turn off the eFuse for the entire group. FIG. 6 can be combined with latching techniques discussed herein.

In circuit 600, input circuit 106_1 is coupled to three voltage regulators 104 (thereby forming a multiphase voltage regulator) and input circuit 106_2 is coupled to three other voltage regulators 104. Each of the power rails has its own output circuit 108_1, 108_2, 109_3, through 108_6. In FIG. 6, each redundant phase is coupled to the same voltage output, such as voltage outputs VOUT1, VOUT2, VOUT3. Although input circuit controller 114 is connected to output circuit controller 124 via the direct connection 150 in FIG. 6, it should be appreciated that latch circuit 310 in FIG. 3 can be used and/or resistor 502 in FIG. 5 can be used in one or more embodiments.

Additionally, circuits 100, 600 can be in any computer system. For example, circuits 100, 600 can be implemented in various components of hardware and software layer 60 depicted in FIG. 10.

The various controllers can be implemented as modules/blocks as understood by one or ordinary skill in the art. The various components, modules, etc., described regarding FIGS. 1-8 can utilize and/or be implemented with/as instructions stored on a computer-readable storage medium, as hardware modules, as special-purpose hardware (e.g., application specific hardware, application specific integrated circuits (ASICs), as embedded controllers, hardwired circuitry, etc.), or as some combination or combinations of these. In examples, the modules described herein can be a combination of hardware and programming. The programming can be processor executable instructions stored on a tangible memory, and the hardware can include processing circuitry for executing those instructions. Alternatively or additionally, the modules can include dedicated hardware, such as one or more integrated circuits, Application Specific Integrated Circuits (ASICs), Application Specific Special Processors (ASSPs), Field Programmable Gate Arrays (FPGAs), or any combination of the foregoing examples of dedicated hardware, for performing the techniques described herein. Further, the modules can include various logic circuits to function as discussed herein.

Figure 7:
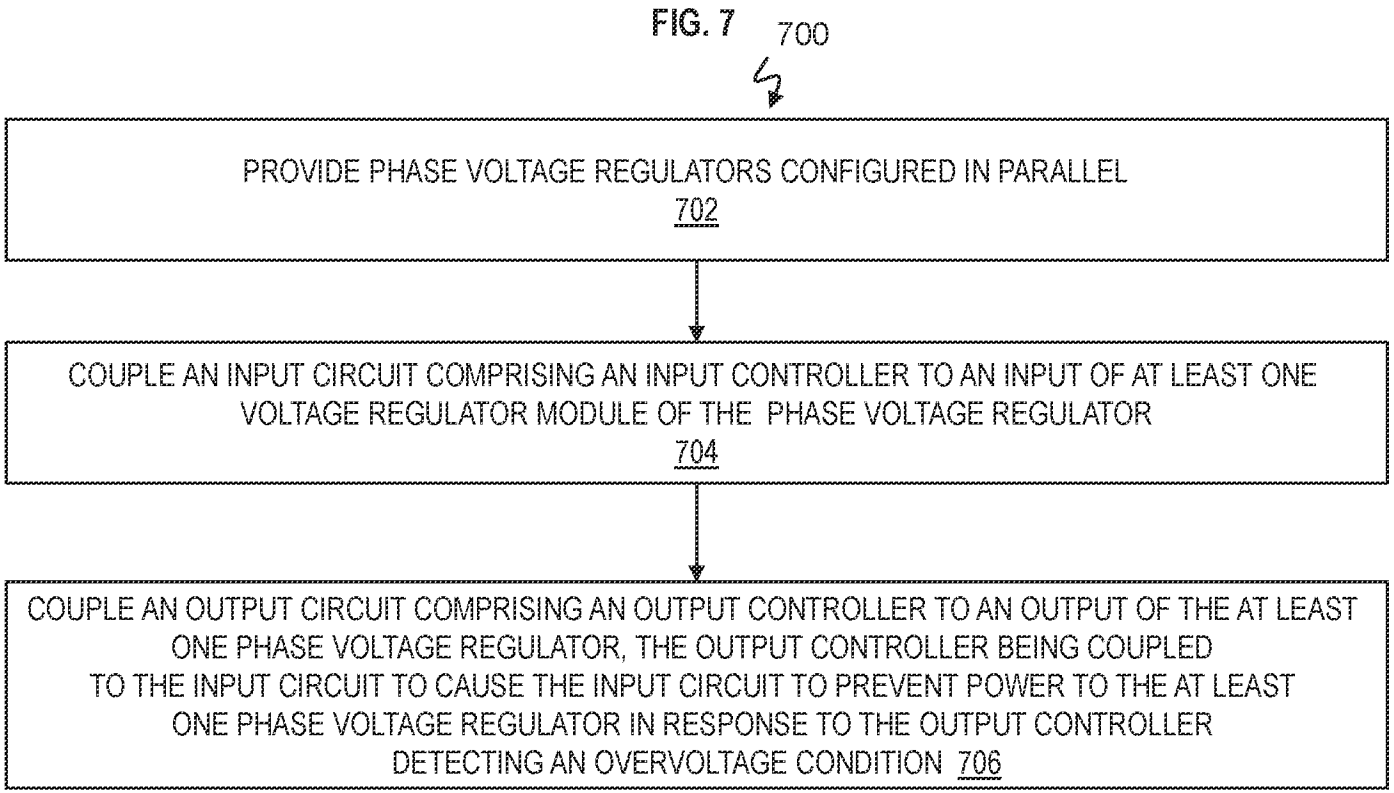
FIG. 7 depicts a flowchart of a method for linking separate input and output controllers for output overvoltage protection in power conversion applications in accordance with one or more embodiments of the present invention.

FIG. 7 is flowchart of a method 700 for linking separate electronic fuse (eFuse) and ORING controllers for output overvoltage protection in power conversion applications in accordance with one or more embodiments of the present invention. The method 700 may be performed using circuits 100, 600 in FIGS. 1, 3, 5, 6 as well as processes 200, 400 discussed in FIGS. 2 and 4. Method 700 will be described with reference to FIGS. 1-6. Further, FIGS. 1-7 may be incorporated in and processed on a node 10 in cloud computing environment 50 of FIG. 9.

At block 702, (phase) voltage regulators 104 are configured in parallel. At block 704, an input circuit (e.g., input circuit 106) includes an input controller (e.g., input circuit controller 114) coupled to an input of at least one voltage regulator 104 of the voltage regulators 104. At block 706, an output circuit (e.g., output circuits 108_1, 108_2, 108_3, 108_4, 108_5, 108_6) comprising an output controller (e.g., output circuit controller 124) is coupled to an output of the at least one voltage regulator 104, the output controller (e.g., output circuit controller 124) being coupled to the input circuit (e.g., input circuit 106) to cause the input circuit to prevent power to the at least one voltage regulator in response to the output controller detecting an overvoltage condition.

The output controller (e.g., output circuit controller 124) is coupled to the input controller (e.g., input circuit controller 114) to cause the input controller to prevent the power to the at least one voltage regulator 104 in response to the output controller detecting the overvoltage condition. A pin (e.g., PG pin) of the output controller (e.g., output circuit controller 124) is coupled to an enable pin (e.g., EN pin) of the input controller (e.g., input circuit controller 114), the enable pin being configured to control the power to the at least one voltage regulator.

The output controller is coupled to the input controller via a latch 302 and a pull-down circuit 304. The input circuit comprises a current sense device, the output controller being coupled to the current sense device (e.g., current sense resistor 110) of the input controller via a resistor (e.g., resistor device 502). The output controller and one or more other output controllers (e.g., output circuit controller 124) are coupled to the input circuit (input circuits 106). Any one or more of the output controllers and the one or more other output controllers are configured to cause the input circuit to prevent the power.

Figure 8:
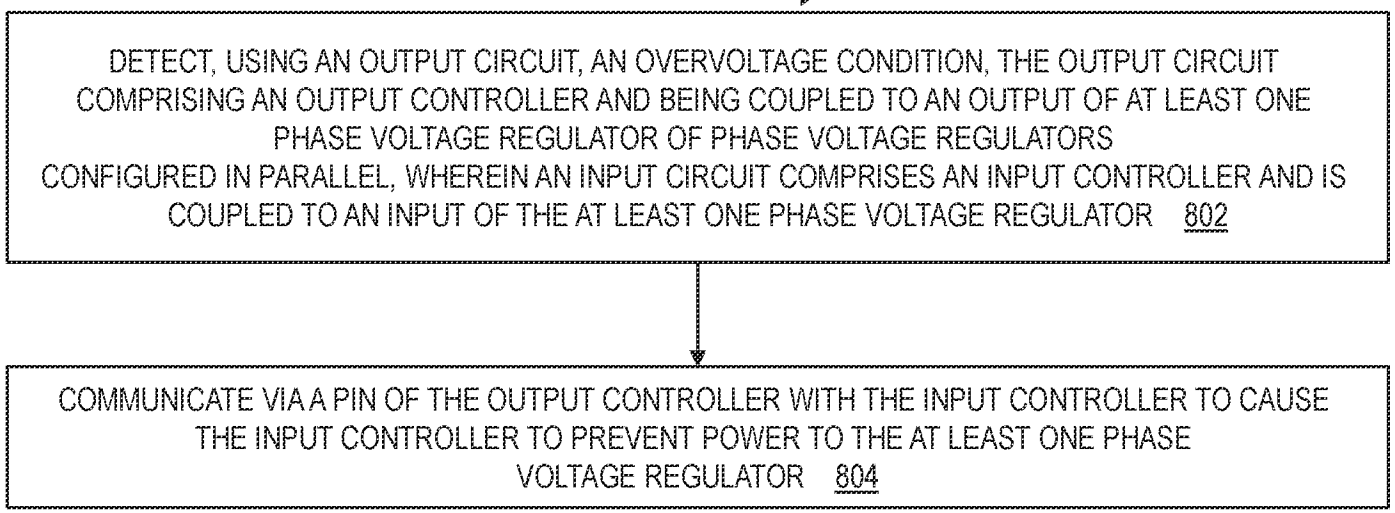
FIG. 8 depicts a flowchart of a method for linking separate input and output controllers for output overvoltage protection in power conversion applications in accordance with one or more embodiments of the present invention.

FIG. 8 is flowchart of a method 800 for linking separate electronic fuse (eFuse) and ORING controllers for output overvoltage protection in power conversion applications in accordance with one or more embodiments of the present invention. The method 800 may be performed using circuits 100, 600 in FIGS. 1, 3, 5, 6 as well as processes 200, 400 discussed in FIGS. 2 and 4. Method 800 will be described with reference to FIGS. 1-6. Further, FIGS. 1-8 may be incorporated in and processed on a node 10 in cloud computing environment 50 of FIG. 9.

At block 802, the method 800 includes detecting, using an output circuit (e.g., output circuits 108), an overvoltage condition, the output circuit including an output controller (e.g., output circuit controller 124) and being coupled to an output of at least one voltage regulator 104 of voltage regulators 104 configured in parallel, where an input circuit (e.g., input circuits 106) comprises an input controller (e.g., input circuit controller 114) and is coupled to an input of the at least one voltage regulator 104. At block 804, the method 800 includes communicating (e.g., by the pulling down voltage and sinking/drawing the current) via a pin of the output controller (e.g., output circuit controller 124) with the input controller (e.g., input circuit controller 114) to cause the input controller to prevent power to the at least one voltage regulator 104.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Figure 9:
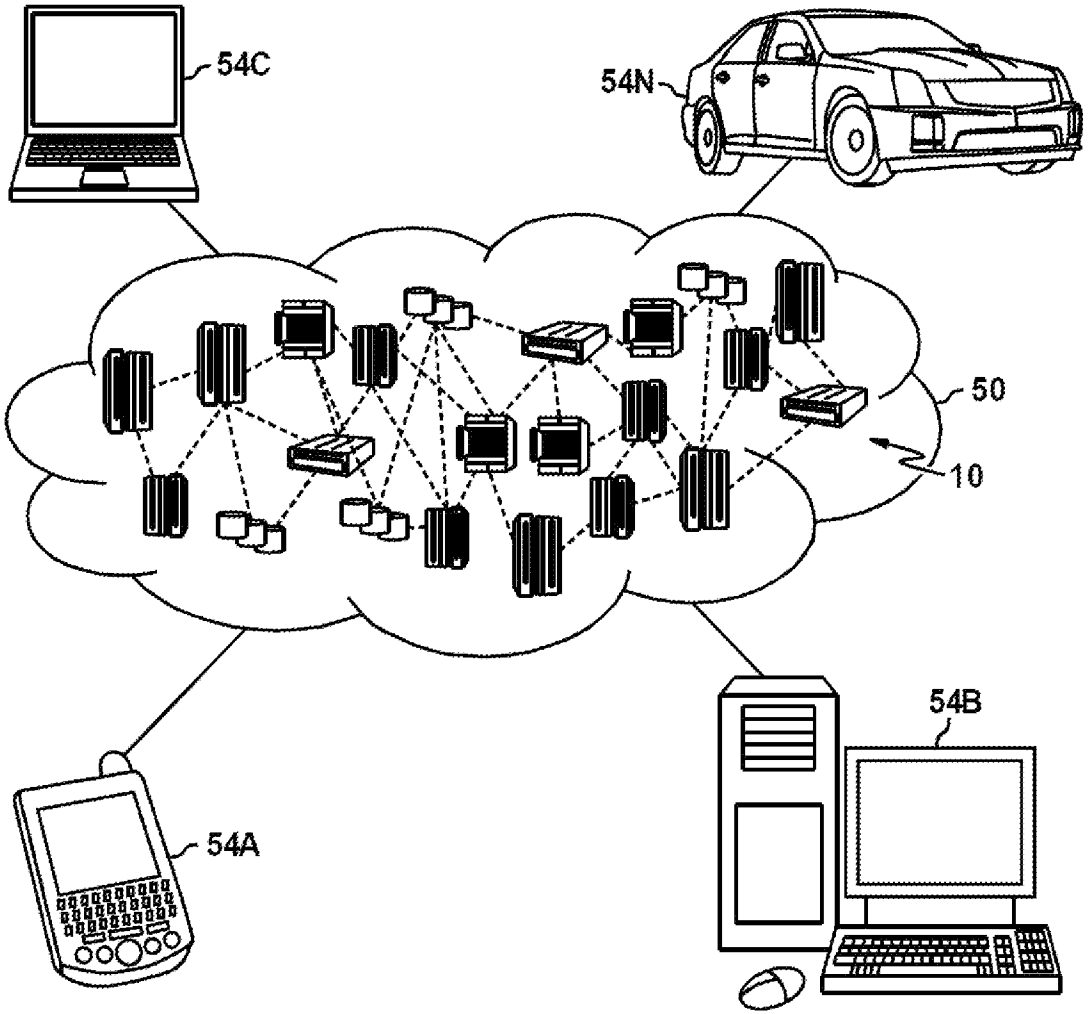
FIG. 9 depicts a cloud computing environment according to one or more embodiments of the present invention.

Referring now to FIG. 9, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described herein above, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 9 are intended to be illustrative only and that computing nodes 10 and cloud computing environment 50 can communicate with any type of computerized device over any type of network and/or network addressable connection (e.g., using a web browser).

Figure 10:
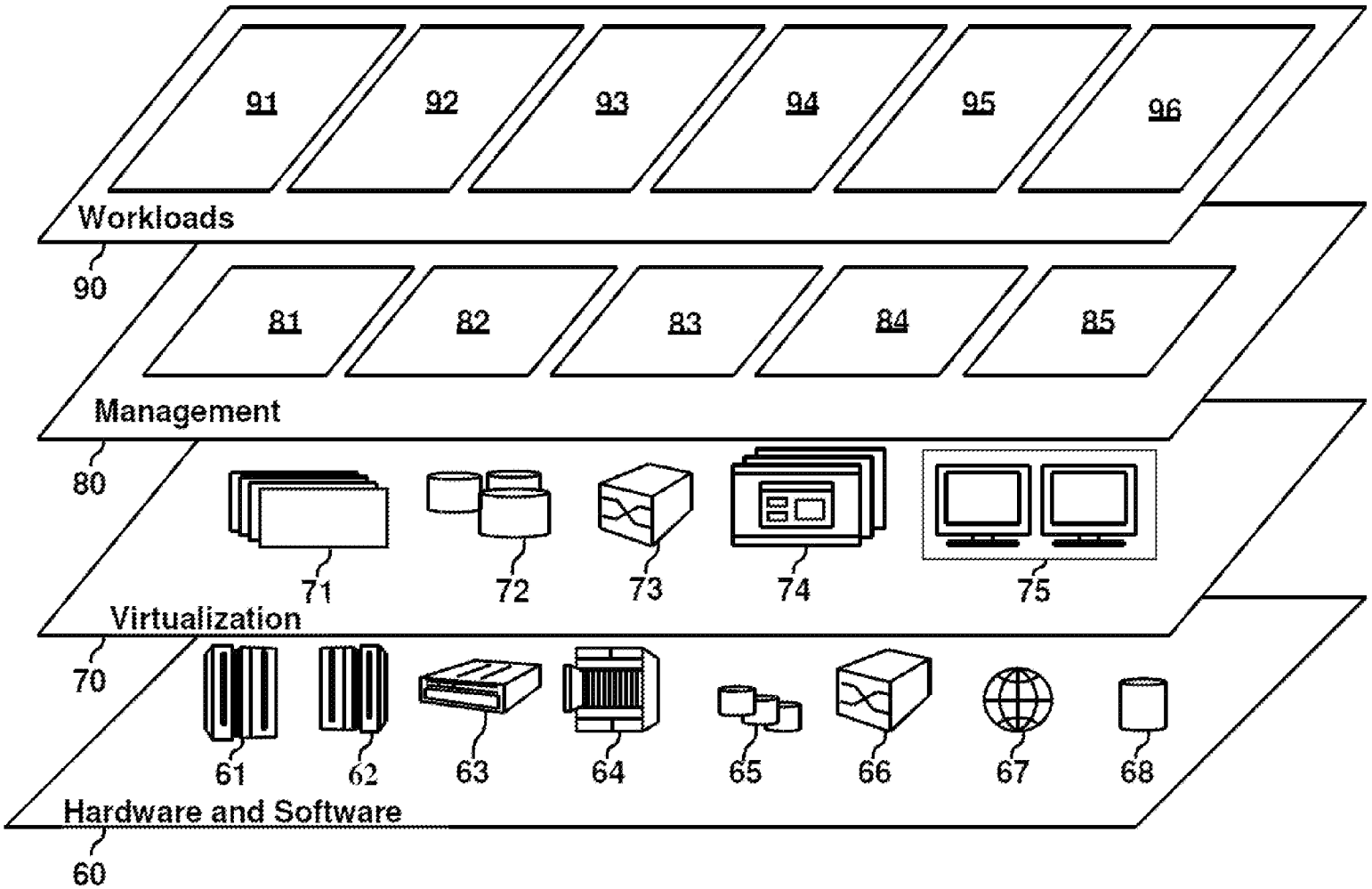
FIG. 10 depicts abstraction model layers according to one or more embodiments of the present invention.

Referring now to FIG. 10, a set of functional abstraction layers provided by cloud computing environment 50 (FIG. 9) is shown. It should be understood in advance that the components, layers, and functions shown in FIG. 10 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and workloads and functions 96.

Various embodiments of the invention are described herein with reference to the related drawings. Alternative embodiments of the invention can be devised without departing from the scope of this invention. Various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. Moreover, the various tasks and process steps described herein can be incorporated into a more comprehensive procedure or process having additional steps or functionality not described in detail herein.

One or more of the methods described herein can be implemented with any or a combination of the following technologies, which are each well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

For the sake of brevity, conventional techniques related to making and using aspects of the invention may or may not be described in detail herein. In particular, various aspects of computing systems and specific computer programs to implement the various technical features described herein are well known. Accordingly, in the interest of brevity, many conventional implementation details are only mentioned briefly herein or are omitted entirely without providing the well-known system and/or process details.

In some embodiments, various functions or acts can take place at a given location and/or in connection with the operation of one or more apparatuses or systems. In some embodiments, a portion of a given function or act can be performed at a first device or location, and the remainder of the function or act can be performed at one or more additional devices or locations.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising,"

when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The present disclosure has been presented for purposes of illustration and description but is not intended to be exhaustive or limited to the form disclosed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

The diagrams depicted herein are illustrative. There can be many variations to the diagram or the steps (or operations) described therein without departing from the spirit of the disclosure. For instance, the actions can be performed in a differing order or actions can be added, deleted or modified. Also, the term "coupled" describes having a signal path between two elements and does not imply a direct connection between the elements with no intervening elements/connections therebetween. All of these variations are considered a part of the present disclosure.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include both an indirect "connection" and a direct "connection."

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instruction by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A circuit comprising:

voltage regulators configured in parallel;

an input circuit comprising an input controller, the input circuit being coupled to an input of at least one voltage regulator of the voltage regulators; and an output circuit comprising an output controller, the output circuit being coupled to an output of the at least one voltage regulator, the output controller being coupled to the input circuit to cause the input circuit to prevent power to the at least one voltage regulator in response to the output controller detecting an overvoltage condition, wherein the output controller is connected to a latch, the latch being connected to a pull-down circuit, the pull-down circuit being connected to the input controller, the latch preventing the output controller from being directly connected to the pull-down circuit.

2. The circuit of claim 1, wherein the output controller is coupled to the input controller to cause the input controller to prevent the power to the at least one voltage regulator in response to the output controller detecting the overvoltage condition.

3. The circuit of claim 1, wherein a pin of the output controller is coupled to an enable pin of the input controller, the enable pin being configured to control the power to the at least one voltage regulator.

4. The circuit of claim 1, wherein the input circuit comprises a current sense device, the output controller being coupled to the current sense device of the input controller via a resistor.

5. The circuit of claim 1, wherein the output controller and one or more other output controllers are coupled to the input circuit.

6. The circuit of claim 5, wherein any one or more of the output controller and the one or more other output controllers are configured to cause the input circuit to prevent the power.

7. A method comprising:

providing voltage regulators configured in parallel;

coupling an input circuit comprising an input controller to an input of at least one voltage regulator of the voltage regulators; and coupling an output circuit comprising an output controller to an output of the at least one voltage regulator, the output controller being coupled to the input circuit to cause the input circuit to prevent power to the at least one voltage regulator in response to the output controller detecting an overvoltage condition, wherein the output controller is connected to a latch, the latch being connected to a pull-down circuit, the pull-down circuit being connected to the input controller, the latch preventing the output controller from being directly connected to the pull-down circuit.

8. The method of claim 7, wherein the output controller is coupled to the input controller to cause the input controller to prevent the power to the at least one voltage regulator in response to the output controller detecting the overvoltage condition.

9. The method of claim 7, wherein a pin of the output controller is coupled to an enable pin of the input controller, the enable pin being configured to control the power to the at least one voltage regulator.

10. The method of claim 7, wherein the input circuit comprises a current sense device, the output controller being coupled to the current sense device of the input controller via a resistor.

11. The method of claim 7, wherein the output controller and one or more other output controllers are coupled to the input circuit.

12. The method of claim 11, wherein any one or more of the output controller and the one or more other output controllers are configured to cause the input circuit to prevent the power.

13. A method comprising;

detecting, using an output circuit, an overvoltage condition, the output circuit comprising an output controller and being coupled to an output of at least one voltage regulator of voltage regulators configured in parallel, wherein an input circuit comprises an input controller and is coupled to an input of the at least one voltage regulator; and communicating via a pin of the output controller with the input controller to cause the input controller to prevent power to the at least one voltage regulator, wherein the output controller is connected to a latch, the latch being connected to a pull-down circuit, the pull-down circuit being connected to the input controller, the latch preventing the output controller from being directly connected to the pull-down circuit.

14. The method of claim 13, wherein the output controller is coupled to the input controller to cause the input controller to prevent the power to the at least one voltage regulator in response to the output controller detecting the overvoltage condition.

15. The method of claim 13, wherein the pin of the output controller is coupled to an enable pin of the input controller, the enable pin being configured to control the power to the at least one voltage regulator.

16. The method of claim 13, wherein the input circuit comprises a current sense device, the output controller being coupled to the current sense device of the input controller via a resistor.

17. The method of claim 13, wherein:

the output controller and one or more other output controllers are coupled to the input circuit; and any one or more of the output controller and the one or more other output controllers are configured to cause the input circuit to prevent the power.

* * * * *